US010964501B2

(12) United States Patent
Tang et al.

(10) Patent No.: US 10,964,501 B2
(45) Date of Patent: Mar. 30, 2021

(54) SINGLE COIL MAGNETIC LATCHING RELAY CONTROL CIRCUIT AND METHOD

(71) Applicant: ZTE CORPORATION, Guangdong (CN)

(72) Inventors: Rongdao Tang, Guangdong (CN); Jian Huang, Guangdong (CN); Wei Qiu, Guangdong (CN)

(73) Assignee: ZTE Corporation, Guangdong (CN)

( * ) Notice: Subject to any disclaimer, the term of this patent is extended or adjusted under 35 U.S.C. 154(b) by 339 days.

(21) Appl. No.: 16/306,471

(22) PCT Filed: Aug. 15, 2016

(86) PCT No.: PCT/CN2016/095347

§ 371 (c)(1),
(2) Date: Nov. 30, 2018

(87) PCT Pub. No.: WO2017/206365

PCT Pub. Date: Dec. 7, 2017

(65) Prior Publication Data

US 2019/0189376 A1 Jun. 20, 2019

(30) Foreign Application Priority Data

Jun. 1, 2016 (CN) ..... 201610387264.6

(51) Int. Cl.
*H01H 47/32* (2006.01)
*H01H 50/32* (2006.01)
(Continued)

(52) U.S. Cl.
CPC ..... *H01H 50/32* (2013.01); *H01H 47/226* (2013.01); *H01H 47/32* (2013.01);
(Continued)

(58) Field of Classification Search
CPC ..... H01H 47/22; H01H 47/226; H01H 47/32; H01H 47/325; H01H 50/021; H01H 50/443; H01H 50/32; H01F 7/1844
(Continued)

(56) References Cited

U.S. PATENT DOCUMENTS 3,975,666 A 8/1976 Redding
4,257,081 A * 3/1981 Sauer ..... H01H 47/226 361/156

(Continued)

FOREIGN PATENT DOCUMENTS

CN 1063967 A 8/1992
CN 2144862 Y 10/1993

(Continued)

OTHER PUBLICATIONS

International Search Report dated Feb. 22, 2017 for International Application No. PCT/CN2016/095347, 8 pages.

(Continued)

*Primary Examiner* — Nguyen Tran
*Assistant Examiner* — Nusrat Quddus
(74) *Attorney, Agent, or Firm* — Knobbe, Martens, Olson & Bear, LLP

(57) ABSTRACT

A control circuit and method for a single coil magnetic latching relay is provided in the present disclosure. The circuit includes: a first control circuit (21) and a first single coil magnetic latching relay coil (22). The first control circuit (21) includes: a first transistor (211), a first diode (212), a second diode (213), a first capacitor (214), a second capacitor (215), a first resistor (216) and a second resistor (217) and the first control circuit (21) is configured to control the first single coil magnetic latching relay coil (22) to enter a preset state and/or maintain the preset state.

20 Claims, 8 Drawing Sheets

(51) Int. Cl.
*H01H 47/22* (2006.01)
*H01H 50/02* (2006.01)
*H01H 50/44* (2006.01)

(52) U.S. Cl.
CPC ..... *H01H 47/325* (2013.01); *H01H 50/021* (2013.01); *H01H 50/443* (2013.01)

(58) Field of Classification Search
USPC ..... 361/139, 144, 160
See application file for complete search history.

(56) References Cited

U.S. PATENT DOCUMENTS 4,533,972 A * 8/1985 Ohashi ..... H01H 47/226 361/156
5,079,667 A 1/1992 Kasano et al.
5,521,535 A * 5/1996 Hori ..... H01H 47/22 327/199
5,815,365 A * 9/1998 Stege ..... H01F 7/1805 361/156
6,057,750 A 5/2000 Sheng
2017/0062163 A1* 3/2017 Nishio ..... H01H 47/226

FOREIGN PATENT DOCUMENTS

CN 102097253 A 6/2011
DE 2624913 B1 10/1977
EP 0380089 A2 8/1990
GB 2009549 A 6/1979
JP S60105128 A 6/1985
JP S60211727 A 10/1985

OTHER PUBLICATIONS

Written Opinion of the International Searching Authority dated Feb. 22, 2017 for International Application No. PCT/CN2016/095347, 3 pages.
Extended European Search Report of corresponding Application No. 16903747.0—3 pages (dated Sep. 30, 2019).

* cited by examiner

SINGLE COIL MAGNETIC LATCHING RELAY CONTROL CIRCUIT AND METHOD

CROSS REFERENCE TO RELATED APPLICATIONS

This is the U.S. National Stage Application under 35 U.S.C. 371 of International Patent Application No. PCT/CN2016/095347, filed on Aug. 15, 2016, which claims priority to Chinese patent application No. 201610387264.6 filed on Jun. 1, 2016, the entire disclosure of each of which is incorporated herein by reference.

TECHNICAL FIELD

The present disclosure relates to, but is not limited to, the field of communications and, in particular, relates to a control circuit and method for a single coil magnetic latching relay.

BACKGROUND

A single coil magnetic latching relay, like other electromagnetic relays, can automatically turn a circuit on and off. The difference is that the closed and open states of the single coil magnetic latching relay completely depends on a permanent magnet, and the switching between on and off states of the single coil magnetic latching relay is triggered by an electric pulse signal of a certain width. Generally, the open and close states of the contact of the single coil magnetic latching relay are maintained by a magnetic force of the permanent magnet. When the contact of the single coil magnetic latching relay needs to be opened or closed, only a positive (negative) direct current pulse voltage is required to excite its coil and the single coil magnetic latching relay switches between the on and off states instantly. Generally, when the contact is maintained open or closed, the coil does not need to be continuously powered and the magnetic force of the permanent magnet can maintain the state of the relay unchanged, thereby reducing power consumption and preventing the coil from generating heat due to being powered for a long time.

A conventional single coil magnetic latching relay generally uses a bridge drive circuit or a silicon controlled drive circuit which have relatively complicated control circuits and high costs.

FIG. 1 is a schematic diagram of a control circuit for a single coil magnetic latching relay in the related art. As shown in FIG. 1, the circuit includes an H-bridge drive circuit composed of two NPN transistors and two PNP transistors. One end of the H-bridge drive circuit is connected to a power supply and the other end is grounded. The circuit further includes a first switching transistor Q305 and a second switching transistor Q306. A base electrode of the first switching transistor Q305 is connected to a first signal terminal RLY-ON, and a collector electrode and an emitter electrode of the first switching transistor Q305 are connected in series between one drive end of the H-bridge drive circuit and the ground. A base electrode of the second switching transistor Q306 is connected to a second signal terminal RLY-OFF, and a collector electrode and an emitter electrode of the second switching transistor Q306 are connected in series between the other drive end of the H-bridge drive circuit and the ground.

It can be seen that when a bridge drive is adopted in the related art, the number of used transistors is large and two independent signals are required to set and reset the single coil magnetic latching relay, resulting in a complicated control circuit.

SUMMARY

Embodiments of the present disclosure provide a control circuit and method for a single coil magnetic latching relay, which reduces the complexity of a control circuit for a single coil magnetic latching relay.

A control circuit for a single coil magnetic latching relay includes a first control circuit and a first single coil magnetic latching relay coil. The first control circuit includes: a first transistor, a first diode, a second diode, a first capacitor, a second capacitor, a first resistor and a second resistor; a collector electrode of the first transistor is connected to an anode of the first diode and a first terminal of the second capacitor; an emitter electrode of the first transistor is connected to an anode of the second diode, a first terminal of the first capacitor and one end of the first single coil magnetic latching relay coil; a base electrode of the first transistor is connected to a cathode of the second diode and a first terminal of the second resistor; a cathode of the first diode is connected to a first terminal of the first resistor; a second terminal of the first resistor is connected to a second terminal of the first capacitor and a second terminal of the second resistor; a second terminal of the second capacitor is connected to an other end of the first single coil magnetic latching relay coil; and the first control circuit is configured to control the first single coil magnetic latching relay coil to enter a preset state and/or maintain the preset state.

In an embodiment, the anode of the first diode is further connected to a high-level input voltage; and the cathode of the second diode is further connected to a low-level input voltage.

In an embodiment, the first control circuit further includes a first drive circuit. A high-level input end of the first drive circuit is connected to the anode of the first diode and a low-level input end of the first drive circuit is connected to the cathode of the second diode, and the first drive circuit is configured to provide a drive voltage for the first single coil magnetic latching relay coil.

In an embodiment, the first drive circuit includes a first power supply and a first control element. A positive electrode of the first power supply is connected to the anode of the first diode, a negative electrode of the first power supply is connected to the first control element, the first control element is connected to the cathode of the second diode, the first power supply is configured to provide the drive voltage for the first single coil magnetic latching relay coil and the first control element is configured to control the first power supply to be turned on or off.

In an embodiment, the first transistor includes an NPN transistor.

A control circuit for a single coil magnetic latching relay includes a second control circuit and a second single coil magnetic latching relay coil. The second control circuit includes: a second transistor, a third diode, a fourth diode, a third capacitor, a fourth capacitor, a third resistor and a fourth resistor; an emitter electrode of the second transistor is connected to a first terminal of the third capacitor, a cathode of the fourth diode and a first terminal of the fourth capacitor; a collector electrode of the second transistor is connected to a first terminal of the third resistor and one end of the second single coil magnetic latching relay coil; a base electrode of the second transistor is connected to an anode of the fourth diode and a first terminal of the fourth resistor;

a second terminal of the fourth resistor is connected to a second terminal of the third capacitor and an anode of the third diode; a cathode of the third diode is connected to a second terminal of the third resistor; a second terminal of the fourth capacitor is connected to an other end of the second single coil magnetic latching relay coil; and the second control circuit is configured to control the second single coil magnetic latching relay coil to enter a preset state and/or maintain the preset state.

In an embodiment, the anode of the fourth diode is further connected to a high-level input voltage; and the collector electrode of the second transistor is further connected to a low-level input voltage.

In an embodiment, the second control circuit further includes a second drive circuit. A high-level input end of the second drive circuit is connected to the anode of the fourth diode and a low-level input end of the second drive circuit is connected to the collector electrode of the second transistor, and the second drive circuit is configured to provide a drive voltage to the second single coil magnetic latching relay coil.

In an embodiment, the second drive circuit includes a second power supply and a second control element, wherein a positive electrode of the second power supply is connected to the second control element, a negative electrode of the second power supply is connected to the collector electrode of the second transistor, the second control element is connected to the anode of the fourth diode, the second power supply is configured to provide the drive voltage for the second single coil magnetic latching relay coil and the second control element is configured to control the second power supply to be turned on or off.

In an embodiment, the second transistor includes a PNP transistor.

A control method for a single coil magnetic latching relay includes the step in which a first control circuit controls a first single coil magnetic latching relay coil to enter a preset state and/or maintain the preset state. The first control circuit includes: a first transistor, a first diode, a second diode, a first capacitor, a second capacitor, a first resistor and a second resistor; a collector electrode of the first transistor is connected to a anode of the first diode and a first terminal of the second capacitor; an emitter electrode of the first transistor is connected to an anode of the second diode, a first terminal of the first capacitor and one end of the first single coil magnetic latching relay coil; a base electrode of the first transistor is connected to a cathode of the second diode and a first terminal of the second resistor; a cathode of the first diode is connected to a first terminal of the first resistor; a second terminal of the first resistor is connected to a second terminal of the first capacitor and a second terminal of the second resistor; and a second terminal of the second capacitor is connected to an other end of the first single coil magnetic latching relay coil.

In an embodiment, the preset state includes a set state and/or a reset state.

In an embodiment, the step in which the first control circuit controls the first single coil magnetic latching relay coil to enter the preset state includes: inputting a high-level drive voltage to the anode of the first diode; and controlling, by a loop consisting of the second capacitor, the first single coil magnetic latching relay coil and the second diode, the first single coil magnetic latching relay coil to enter the set state.

In an embodiment, after the first single coil magnetic latching relay coil is controlled to enter the set state, the method further includes: turning off the drive voltage inputted to the anode of the first diode; and controlling, by the first control circuit, the first single coil magnetic latching relay coil to enter the reset state.

A control method for a single coil magnetic latching relay includes the step in which a second control circuit controls a second single coil magnetic latching relay coil to enter a preset state and/or maintain the preset state. The second control circuit includes: a second transistor, a third diode, a fourth diode, a third capacitor, a fourth capacitor, a third resistor and a fourth resistor; an emitter electrode of the second transistor is connected to a first terminal of the third capacitor, a cathode of the fourth diode and a first terminal of the fourth capacitor; a collector electrode of the second transistor is connected to a first terminal of the third resistor and one end of the second single coil magnetic latching relay coil; a base electrode of the second transistor is connected to an anode of the fourth diode and a first terminal of the fourth resistor; a second terminal of the fourth resistor is connected to a second terminal of the third capacitor and an anode of the third diode; a cathode of the third diode is connected to a second terminal of the third resistor; and a second terminal of the fourth capacitor is connected to an other end of the second single coil magnetic latching relay coil.

In an embodiment, the preset state includes a set state and/or a reset state.

In an embodiment, the step in which the second control circuit controls the second single coil magnetic latching relay coil to enter the preset state includes: inputting a high-level drive voltage to the anode of the fourth diode; and controlling, by a loop consisting of the fourth diode, the fourth capacitor and the second single coil magnetic latching relay coil, the second single coil magnetic latching relay coil to enter the set state.

In an embodiment, after the second single coil magnetic latching relay coil is controlled to enter the set state, the method further includes: turning off the drive voltage inputted to the anode of the fourth diode after controlling the second single coil magnetic latching relay coil to enter the set state; and controlling, by the second control circuit, the second single coil magnetic latching relay coil to enter the reset state.

A computer-readable storage medium is configured to store computer-executable instructions, which, when executed by a processor, execute the control method for a single coil magnetic latching relay.

The control circuit for a single coil magnetic latching relay in an embodiment of the present disclosure includes the first control circuit and the first single coil magnetic latching relay coil. The first control circuit includes: the first transistor, the first diode, the second diode, the first capacitor, the second capacitor, the first resistor and the second resistor; the collector electrode of the first transistor is connected to the anode of the first diode and the first terminal of the second capacitor; the emitter electrode of the first transistor is connected to the anode of the second diode, the first terminal of the first capacitor and the one end of the first single coil magnetic latching relay coil; the base electrode of the first transistor is connected to the cathode of the second diode and the first terminal of the second resistor; the cathode of the first diode is connected to the first terminal of the first resistor; the second terminal of the first resistor is connected to the second terminal of the first capacitor and the second terminal of the second resistor; the second terminal of the second capacitor is connected to the other end of the first single coil magnetic latching relay coil; and the first control circuit is configured to control the first single coil magnetic latching relay coil to enter the preset state and/or maintain the preset state. It can be seen that the control circuit for a single coil magnetic latching relay includes one transistor, thereby reducing complexity of a control circuit for a single coil magnetic latching relay .

DETAILED DESCRIPTION

Embodiments of the present disclosure will be described below in detail with reference to the accompanying drawings. It is to be noted that if not in collision, the embodiments and features therein in the present application may be combined with each other.

It is to be noted that the terms "first", "second" and the like in the description, claims and above accompanying drawings of the present disclosure are used to distinguish between similar objects and are not necessarily used to describe a particular order or sequence.

Embodiment 1

Figure 1:
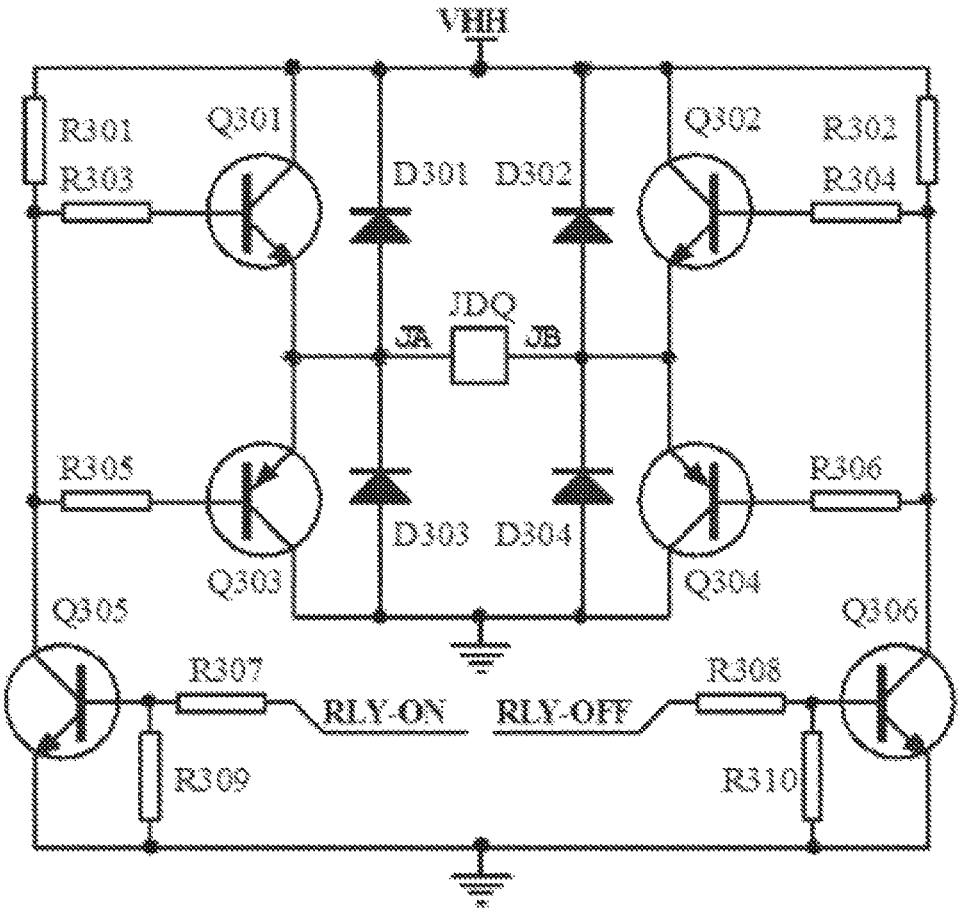
FIG. 1 is a schematic diagram of a control circuit for a single coil magnetic latching relay in the related art.
Figure 2:
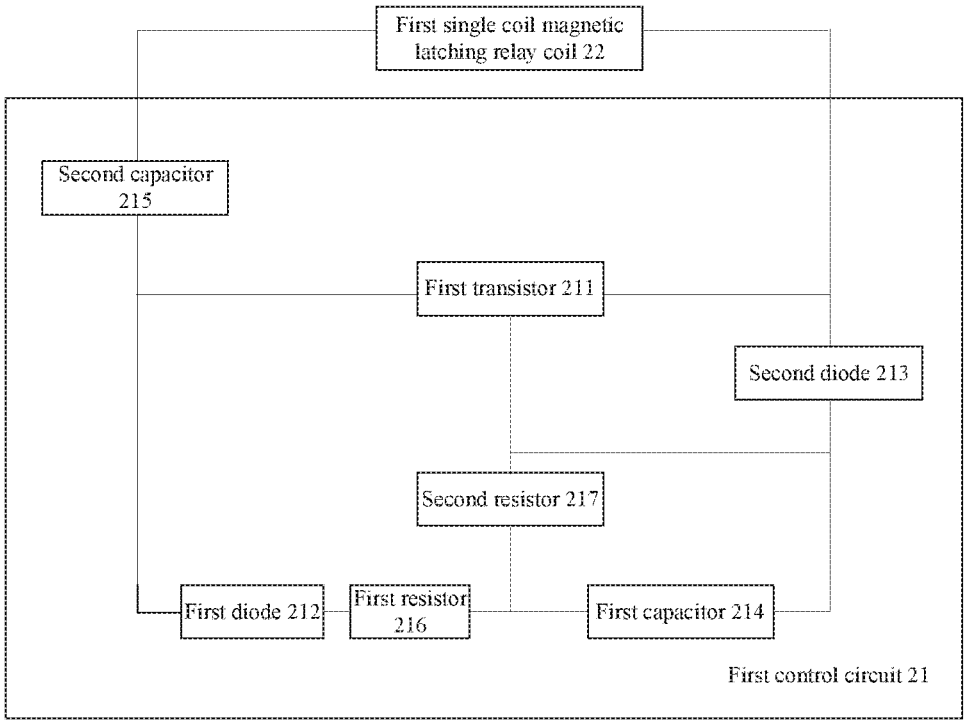
FIG. 2 is a schematic diagram 1 of a control circuit for a single coil magnetic latching relay according to an embodiment of the present disclosure.

A control circuit for a single coil magnetic latching relay is provided in this embodiment. FIG. 2 is a schematic diagram 1 of a control circuit for a single coil magnetic latching relay according to an embodiment of the present disclosure. As shown in FIG. 2, the circuit includes a first control circuit 21 and a first single coil magnetic latching relay coil 22.

The first control circuit 21 includes: a first transistor 211, a first diode 212, a second diode 213, a first capacitor 214, a second capacitor 215, a first resistor 216 and a second resistor 217.

A collector electrode of the first transistor 211 is connected to an anode of the first diode 212 and a first terminal of the second capacitor 215. An emitter electrode of the first transistor 211 is connected to an anode of the second diode 213, a first terminal of the first capacitor 214 and one end of the first single coil magnetic latching relay coil 22. A base electrode of the first transistor 211 is connected to a cathode of the second diode 213 and a first terminal of the second resistor 217.

A cathode of the first diode 212 is connected to a first terminal of the first resistor 216. A second terminal of the first resistor 216 is connected to a second terminal of the first capacitor 214 and a second terminal of the second resistor 217.

A second terminal of the second capacitor 215 is connected to an other end of the first single coil magnetic latching relay coil 22.

The first control circuit 21 is configured to control the first single coil magnetic latching relay coil 22 to enter a preset state and/or maintain the preset state.

The above control circuit for a single coil magnetic latching relay includes the first control circuit and the first single coil magnetic latching relay coil. The first control circuit includes: the first transistor, the first diode, the second diode, the first capacitor, the second capacitor, the first resistor and the second resistor; the collector electrode of the first transistor is connected to the anode of the first diode and the first terminal of the second capacitor; the emitter electrode of the first transistor is connected to the anode of the second diode, the first terminal of the first capacitor and the one end of the first single coil magnetic latching relay coil; the base electrode of the first transistor is connected to the cathode of the second diode and the first terminal of the second resistor; the cathode of the first diode is connected to the first terminal of the first resistor; the second terminal of the first resistor is connected to the second terminal of the first capacitor and the second terminal of the second resistor; the second terminal of the second capacitor is connected to the other end of the first single coil magnetic latching relay coil; and the first control circuit is configured to control the first single coil magnetic latching relay coil to enter the preset state and/or maintain the preset state. It can be seen that the control circuit for a single coil magnetic latching relay includes one transistor, thereby reducing complexity of a control circuit for a single coil magnetic latching relay.

In this embodiment, the first transistor may include, but is not limited to, an NPN transistor.

In an embodiment, the anode of the first diode may be further connected to a high-level input voltage and the cathode of the second diode may be further connected to a low-level input voltage, but this is not intended to limit the present disclosure.

Figure 3:
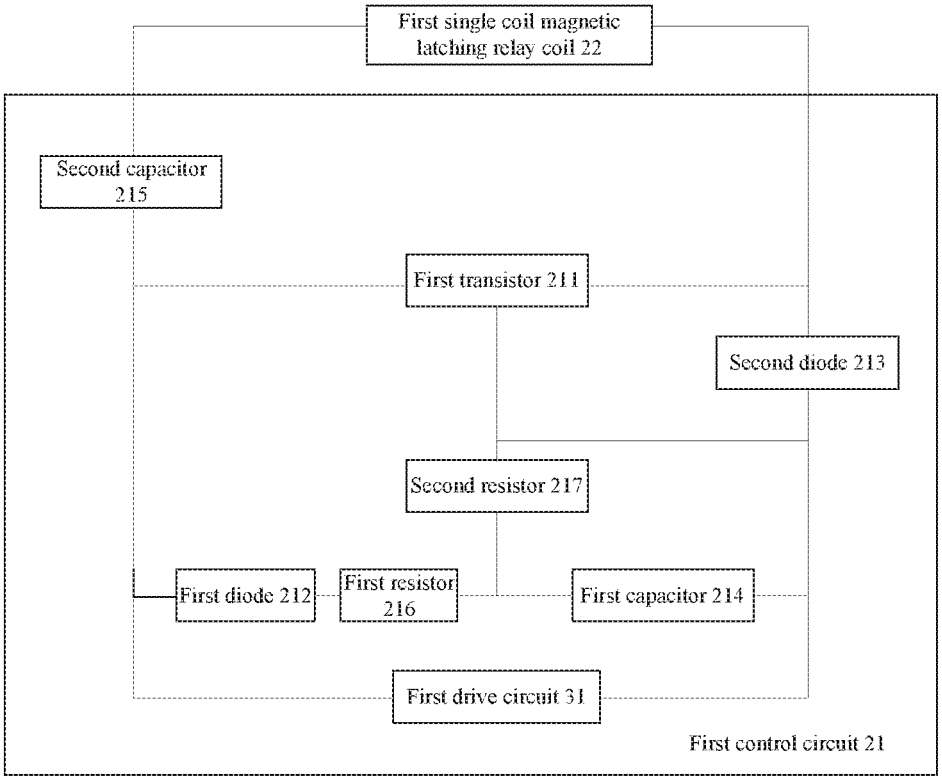
FIG. 3 is a schematic diagram 2 of a control circuit for a single coil magnetic latching relay according to an embodiment of the present disclosure.

FIG. 3 is a schematic diagram 2 of a control circuit for a single coil magnetic latching relay according to an embodiment of the present disclosure. As shown in FIG. 3, in an embodiment, the first control circuit 21 further includes a first drive circuit 31. A high-level input end of the first drive circuit 31 is connected to the anode of the first diode 212 and a low-level input end of the first drive circuit 31 is connected to the cathode of the second diode 213, and the first drive circuit 31 is configured to provide a drive voltage for the first single coil magnetic latching relay coil 22.

Figure 4:
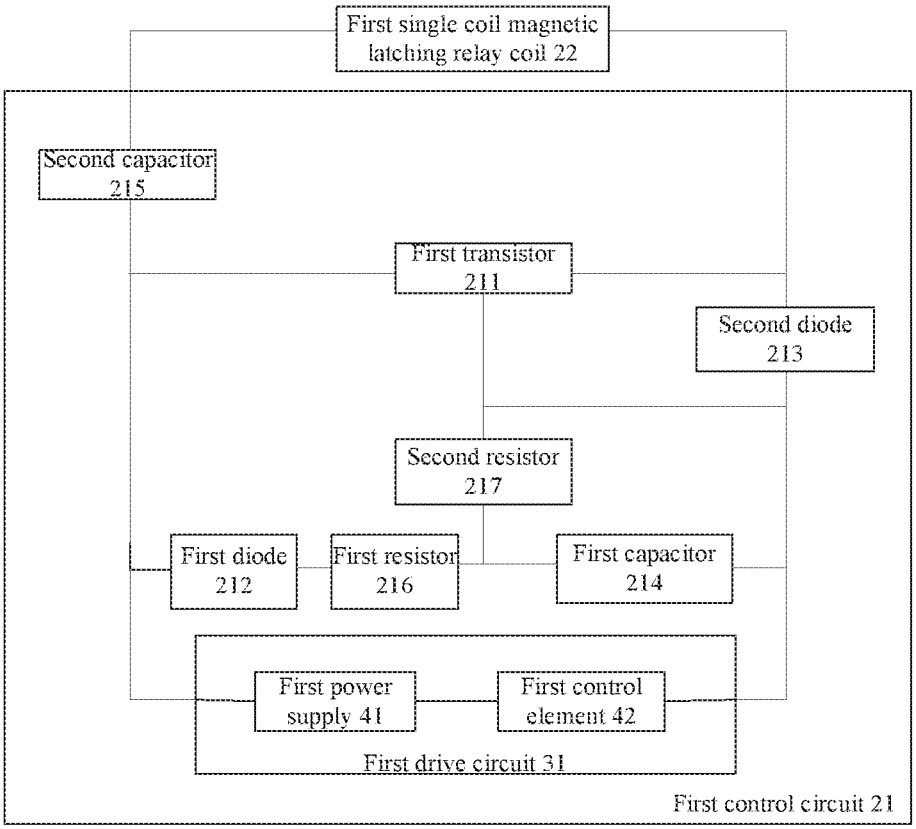
FIG. 4 is a schematic diagram 3 of a control circuit for a single coil magnetic latching relay according to an embodiment of the present disclosure.

FIG. 4 is a schematic diagram 3 of a control circuit for a single coil magnetic latching relay according to an embodiment of the present disclosure. As shown in FIG. 4, in an embodiment, the first drive circuit 31 includes a first power supply 41 and a first control element 42. A positive electrode of the first power supply 41 is connected to the anode of the first diode 212, a negative electrode of the first power supply 41 is connected to the first control element 42, the first control element 42 is connected to the cathode of the second diode 213, the first power supply 41 is configured to provide the drive voltage for the first single coil magnetic latching relay coil and the first control element 42 is configured to control the first power supply to be turned on or off.

In an embodiment, the first control element may include, but is not limited to, an NMOS transistor.

Embodiment 2

Figure 5:
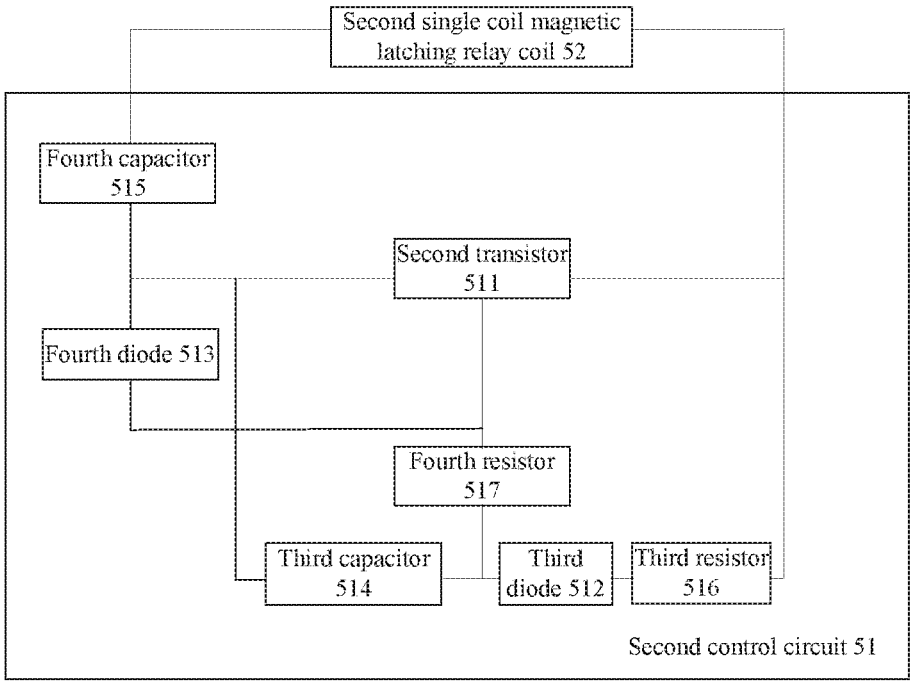
FIG. 5 is a schematic diagram 4 of a control circuit for a single coil magnetic latching relay according to an embodiment of the present disclosure.

A control circuit for a single coil magnetic latching relay is provided in this embodiment. FIG. 5 is a schematic diagram 4 of a control circuit for a single coil magnetic latching relay according to an embodiment of the present disclosure. As shown in FIG. 5, the circuit includes a second control circuit 51 and a second single coil magnetic latching relay coil 52.

The second control circuit 51 includes: a second transistor 511, a third diode 512, a fourth diode 513, a third capacitor 514, a fourth capacitor 515, a third resistor 516 and a fourth resistor 517.

An emitter electrode of the second transistor 511 is connected to a first terminal of the third capacitor 514, a cathode of the fourth diode 513 and a first terminal of the fourth capacitor 515.

A collector electrode of the second transistor 511 is connected to a first terminal of the third resistor 516 and one end of the second single coil magnetic latching relay coil 52. A base electrode of the second transistor 511 is connected to an anode of the fourth diode 513 and a first terminal of the fourth resistor 517.

A second terminal of the fourth resistor 517 is connected to a second terminal of the third capacitor 514 and an anode of the third diode 512. A cathode of the third diode 512 is connected to a second terminal of the third resistor 516.

A second terminal of the fourth capacitor 515 is connected to an other end of the second single coil magnetic latching relay coil 52.

The second control circuit 51 is configured to control the second single coil magnetic latching relay coil 52 to enter a preset state and/or maintain the preset state.

The above control circuit for a single coil magnetic latching relay includes the second control circuit and the second single coil magnetic latching relay coil. The second control circuit includes: the second transistor, the third diode, the fourth diode, the third capacitor, the fourth capacitor, the third resistor and the fourth resistor; the emitter electrode of the second transistor is connected to the first terminal of the third capacitor, the cathode of the fourth diode and the first terminal of the fourth capacitor; the collector electrode of the second transistor is connected to the first terminal of the third resistor and the one end of the second single coil magnetic latching relay coil; the base electrode of the second transistor is connected to the anode of the fourth diode and the first terminal of the fourth resistor; the second terminal of the fourth resistor is connected to the second terminal of the third capacitor and the anode of the third diode; the cathode of the third diode is connected to the second terminal of the third resistor; the second terminal of the fourth capacitor is connected to the other end of the second single coil magnetic latching relay coil; and the second control circuit is configured to control the second single coil magnetic latching relay coil to enter the preset state and/or maintain the preset state.

It can be seen that the control circuit for a single coil magnetic latching relay includes one transistor, thereby reducing complexity of a control circuit for a single coil magnetic latching relay.

In this embodiment, the second transistor may include, but is not limited to, a PNP transistor.

In an embodiment, the anode of the fourth diode may be further connected to a high-level input voltage and the collector electrode of the second transistor may be further connected to a low-level input voltage, but this is not intended to limit the present disclosure.

Figure 6:
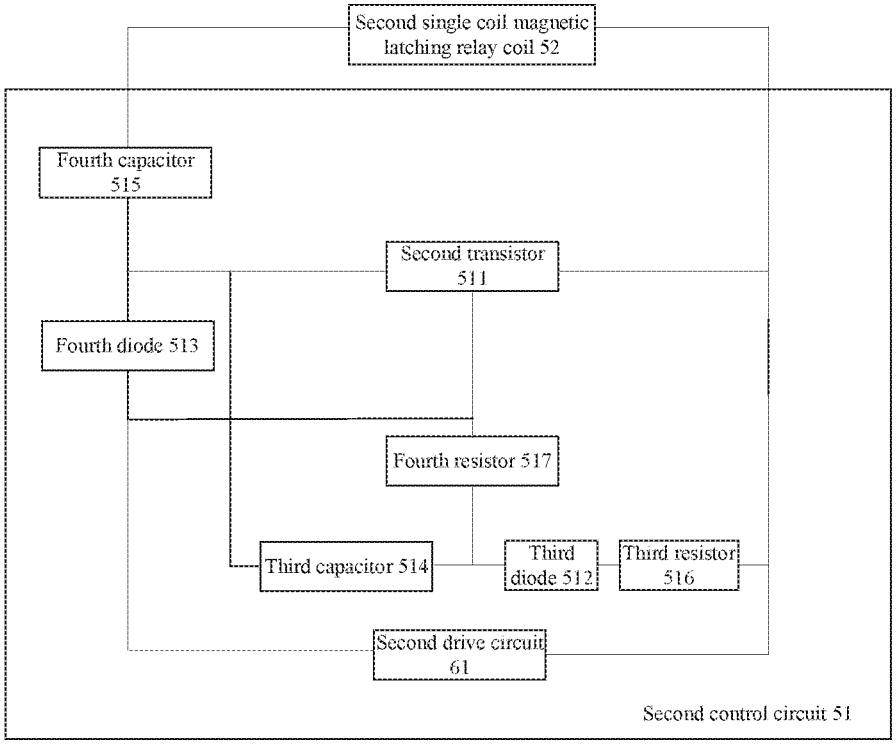
FIG. 6 is a schematic diagram 5 of a control circuit for a single coil magnetic latching relay according to an embodiment of the present disclosure.

FIG. 6 is a schematic diagram 5 of a control circuit for a single coil magnetic latching relay according to an embodiment of the present disclosure. As shown in FIG. 6, in an embodiment, the second control circuit 51 further includes a second drive circuit 61. A high-level input end of the second drive circuit 61 is connected to the anode of the fourth diode 513 and a low-level input end of the second drive circuit 61 is connected to the collector electrode of the second transistor 511, and the second drive circuit 61 is configured to provide a drive voltage for the second single coil magnetic latching relay coil.

Figure 7:
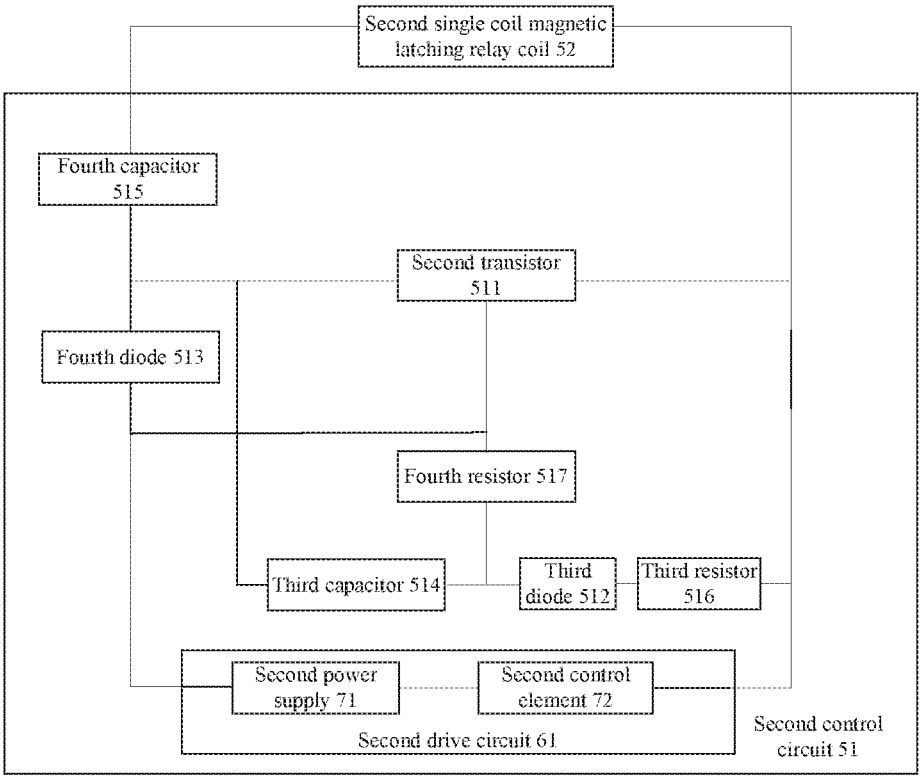
FIG. 7 is a schematic diagram 6 of a control circuit for a single coil magnetic latching relay according to an embodiment of the present disclosure.

FIG. 7 is a schematic diagram 6 of a control circuit for a single coil magnetic latching relay according to an embodiment of the present disclosure. As shown in FIG. 7, in an embodiment, the second drive circuit 61 includes a second power supply 71 and a second control element 72. A positive electrode of the second power supply 71 is connected to the second control element 72, a negative electrode of the second power supply 71 is connected to the collector electrode of the second transistor 511, the second control element 72 is connected to the anode of the fourth diode 513, the second power supply 71 is configured to provide the drive voltage for the second single coil magnetic latching relay coil 52 and the second control element 72 is configured to control the second power supply 71 to be turned on or off.

In an embodiment, the second control element may include, but is not limited to, a PMOS transistor.

Embodiment 3

A control method for a single coil magnetic latching relay is provided in this embodiment. The method includes the step described below.

A first control circuit controls a first single coil magnetic latching relay coil to enter a preset state and/or maintain the preset state.

The first control circuit includes: a first transistor, a first diode, a second diode, a first capacitor, a second capacitor, a first resistor and a second resistor. A collector electrode of the first transistor is connected to an anode of the first diode and a first terminal of the second capacitor. An emitter electrode of the first transistor is connected to an anode of the second diode, a first terminal of the first capacitor and one end of the first single coil magnetic latching relay coil. A base electrode of the first transistor is connected to a cathode of the second diode and a first terminal of the second resistor. A cathode of the first diode is connected to a first terminal of the first resistor. A second terminal of the first resistor is connected to a second terminal of the first capacitor and a second terminal of the second resistor. A second terminal of the second capacitor is connected to an other end of the first single coil magnetic latching relay coil.

In the above step, the first control circuit controls the first single coil magnetic latching relay coil to enter the preset state and/or maintain the preset state. The first control circuit includes: the first transistor, the first diode, the second diode, the first capacitor, the second capacitor, the first resistor and the second resistor; the collector electrode of the first transistor is connected to the anode of the first diode and the first terminal of the second capacitor; the emitter electrode of the first transistor is connected to the anode of the second diode, the first terminal of the first capacitor and the one end of the first single coil magnetic latching relay coil; the base electrode of the first transistor is connected to the cathode of the second diode and the first terminal of the second resistor; the cathode of the first diode is connected to the first terminal of the first resistor; the second terminal of the first resistor is connected to the second terminal of the first capacitor and the second terminal of the second resistor; and the second terminal of the second capacitor is connected to the other end of the first single coil magnetic latching relay coil. It can be seen the first control circuit is used to control the first single coil magnetic latching relay coil and the first control circuit includes one transistor, thereby reducing complexity of a control circuit for a single coil magnetic latching relay.

In this embodiment, the first transistor may include, but is not limited to, an NPN transistor.

In this embodiment, the preset state may include, but is not limited to, a set state and/or a reset state.

In an embodiment, a manner of controlling the first single coil magnetic latching relay coil to enter the set state may include, but is not limit to, inputting a high-level drive voltage to the anode of the first diode and controlling, by a loop consisting of the second capacitor, the first single coil magnetic latching relay coil and the second diode, the first single coil magnetic latching relay coil to enter the set state.

In an embodiment, after the first single coil magnetic latching relay coil is controlled to enter the set state, a manner of controlling the first single coil magnetic latching relay coil to enter the reset state may include, but is not limit to, turning off the drive voltage inputted to the anode of the first diode and controlling, by the first control circuit, the first single coil magnetic latching relay coil to enter the reset state.

Embodiment 4

A control method for a single coil magnetic latching relay is provided in this embodiment. The method includes the step described below.

A second control circuit controls a second single coil magnetic latching relay coil to enter a preset state and/or maintain the preset state.

The second control circuit includes: a second transistor, a third diode, a fourth diode, a third capacitor, a fourth capacitor, a third resistor and a fourth resistor. An emitter electrode of the second transistor is connected to a first terminal of the third capacitor, a cathode of the fourth diode and a first terminal of the fourth capacitor. A collector electrode of the second transistor is connected to a first terminal of the third resistor and one end of the second single coil magnetic latching relay coil. A base electrode of the second transistor is connected to an anode of the fourth diode and a first terminal of the fourth resistor. A second terminal of the fourth resistor is connected to a second terminal of the third capacitor and an anode of the third diode. A cathode of the third diode is connected to a second terminal of the third resistor. A second terminal of the fourth capacitor is connected to an other end of the second single coil magnetic latching relay coil.

In the above step, the second control circuit controls the second single coil magnetic latching relay coil to enter the preset state and/or maintain the preset state.

The second control circuit includes: the second transistor, the third diode, the fourth diode, the third capacitor, the fourth capacitor, the third resistor and the fourth resistor; the emitter electrode of the second transistor is connected to the first terminal of the third capacitor, the cathode of the fourth diode and the first terminal of the fourth capacitor; the collector electrode of the second transistor is connected to the first terminal of the third resistor and one end of the second single coil magnetic latching relay coil; the base electrode of the second transistor is connected to the anode of the fourth diode and the first terminal of the fourth resistor; the second terminal of the fourth resistor is connected to the second terminal of the third capacitor and the anode of the third diode; the cathode of the third diode is connected to the second terminal of the third resistor; and the second terminal of the fourth capacitor is connected to the other end of the second single coil magnetic latching relay coil. It can be seen that the second control circuit is used to control the second single coil magnetic latching relay coil and the second control circuit includes one transistor, thereby reducing complexity of a control circuit for a single coil magnetic latching relay.

In this embodiment, the second transistor may include, but is not limited to, a PNP transistor.

In this embodiment, the preset state may include, but is not limited to, a set state and/or a reset state.

In an embodiment, a manner in which the second control circuit controls the second single coil magnetic latching relay coil to enter the set state may include, but is not limit to, inputting a high-level drive voltage to the anode of the fourth diode and controlling, by a loop consisting of the fourth diode, the fourth capacitor and the second single coil magnetic latching relay coil, the second single coil magnetic latching relay coil to enter the set state.

In an embodiment, after the second single coil magnetic latching relay coil is controlled to enter the set state, a manner of controlling the second single coil magnetic latching relay coil to enter the reset state may include, but is not limit to, turning off the drive voltage inputted to the anode of the fourth diode and controlling, by the second control circuit, the second single coil magnetic latching relay coil to enter the reset state.

The present disclosure will be described below in detail with reference to an optional embodiment.

This optional embodiment employs a plurality of resistors, capacitors and diodes and one transistor to enable a single coil magnetic latching relay to perform excitation on a coil with a positive (negative) direct current pulse voltage, providing a drive circuit of the single coil magnetic latching relay characterized by a simple structure and low costs.

An optional embodiment of the present disclosure provides a control circuit for a single coil magnetic latching relay. The circuit includes: a transistor T, a diode D01, a diode D02, a capacitor C01, a capacitor C02, a resistor R01, a resistor R02 and a relay coil J. The transistor T may be an NPN transistor or a PNP transistor.

The case in which the transistor T is the NPN transistor is described below.

The diode D01 is connected to the resistor R01 in series, an anode of the diode D01 is connected to an input IN+, a collector electrode of the transistor T and the capacitor C02.

The other terminal of the resistor R01 is connected to the resistor R02 and the capacitor C01.

The other terminal of the resistor R02 is connected to an input IN−, a base electrode of the transistor T and a cathode of the diode D02.

The other terminal of the capacitor C02 is connected to one end of the relay coil J.

The other terminal of the capacitor C01 is connected to an emitter electrode of the transistor T, an anode of the diode D02 and the other end of the relay coil J.

When the transistor T is the NPN transistor, an optional embodiment of the present disclosure further provides a method for controlling a single coil magnetic latching relay by a drive circuit of the single coil magnetic latching relay. The method includes the steps described below.

A high-level drive voltage is inputted across the input IN+ and the input IN−. A loop consisting of the capacitor C02, the relay coil J and the diode D02 is formed to apply a voltage across the relay coil J. The voltage is positive on the top and negative on the bottom of the relay coil J. At this time, the relay is in a set state.

When the diode D02 is turned on, since the base electrode and the emitter electrode of the transistor T are in a reverse bias state, the transistor T is in an off state.

The capacitor C02 starts being charged and the voltage applied across the relay coil J begins to decrease after the set state of the single coil magnetic latching relay until the circuit is equivalent to an open circuit. A magnetic force of a permanent magnet can maintain the single coil magnetic latching relay in the set state.

After the charging of the capacitor C02 completes, a voltage across the capacitor C02 is a difference between the high-level input voltage and a voltage drop of the diode D02.

The capacitor C01 starts being charged by a loop consisting of the input IN+, the diode D01, the resistor R01, the diode D02 and the input IN−. After the charging of the capacitor C01 completes, a voltage across the capacitor C01 is close to a divided voltage of the resistor R01 and the resistor R02.

When the input IN+ or the input IN− is open, the capacitor C02 starts discharging, voltages at the collector electrode and emitter electrode of the transistor T decrease, and the capacitor C01 provides a base current through the resistor R02 and a PN junction between the base electrode and the emitter electrode of the transistor T. The diode D01 is in a reverse bias state, so that the voltage on the capacitor C01 is higher than a voltage at the input IN+ and the transistor T enters a saturation state quickly. The voltage on the capacitor C02 is discharged through the transistor T in the saturated state to apply a drive voltage across the relay coil J. The drive voltage is negative on the top and positive on the bottom of the relay coil J and enables the single coil magnetic latching relay to stay in a reset state.

After the reset state of the single coil magnetic latching relay, the capacitor C01 and the capacitor C02 gradually complete discharging. At this time, a current no longer flows through the relay coil, but the magnetic force of the permanent magnet can maintain the single coil magnetic latching relay in the reset state.

The case in which the transistor T is the PNP transistor is described below.

The diode D01 is connected to the resistor R01 in series. The resistor R01 is connected to an input IN−, a collector electrode of the transistor T and the relay coil J.

An anode of the diode D01 is connected to the resistor R02 and the capacitor C01.

The other terminal of the resistor R02 is connected to an input IN+, a base electrode of the transistor T and an anode of the diode D02.

The other terminal of the capacitor C01 is connected to an emitter electrode of the transistor T, a cathode of the diode D02 and the capacitor C02.

The other terminal of the capacitor C02 is connected to the other end of the relay coil J.

When the transistor T is the PNP transistor, an optional embodiment of the present disclosure further provides a method for controlling a single coil magnetic latching relay by a drive circuit of the single coil magnetic latching relay. The method includes the steps described below.

A high-level drive voltage is inputted across the input IN+ and the input IN−. A loop consisting of the diode D02, the capacitor C02 and the relay coil J is formed to apply a voltage across the relay coil J. The voltage is positive on the top and negative on the bottom of the relay coil J. At this time, the single coil magnetic latching relay is in a set state.

When the diode D02 is turned on, since the base electrode and the emitter electrode of the transistor T are in a reverse bias state, the transistor T is in an off state.

The capacitor C02 starts being charged and the voltage applied across the relay coil begins to decrease after the set state of the single coil magnetic latching relay until the circuit is equivalent to an open circuit. A magnetic force of a permanent magnet can maintain the single coil magnetic latching relay in the set state.

After the charging of the capacitor C02 completes, a voltage across the capacitor C02 is a difference between the high-level input voltage and a voltage drop of the diode D02.

The capacitor C01 starts being charged by a loop consisting of the input IN+, the diode D02, the diode D01, the resistor R01 and the input IN−. After the capacitor C01 is charged, a voltage on the capacitor C01 is close to a divided voltage of the resistor R02 and the resistor R01.

When a signal of the input IN+ or the input IN− is open, the capacitor C02 starts discharging, voltages across the collector electrode and emitter electrode of the transistor T decrease and the capacitor C01 provides a base current through the resistor R02 and a PN junction between the base electrode and the emitter electrode of the transistor T. The diode D01 is in a reverse bias state so that a voltage at the base electrode is lower than a voltage at the collector electrode of the transistor T and the transistor T enters a saturation state quickly. The voltage on the capacitor C01 is discharged through the transistor T in the saturated state to apply a drive voltage across the relay coil J. The drive voltage is negative on the top and positive on the bottom of the relay coil J and enables the single coil magnetic latching relay to stay in a reset state.

After the reset state of the single coil magnetic latching relay, the capacitor C01 and the capacitor C02 gradually complete discharging. At this time, a current no longer flows through the relay coil, but the magnetic force of the permanent magnet can maintain the single coil magnetic latching relay in the reset state.

The optional embodiment of the present disclosure will be described below in detail with reference to the accompanying drawings.

Figure 8:
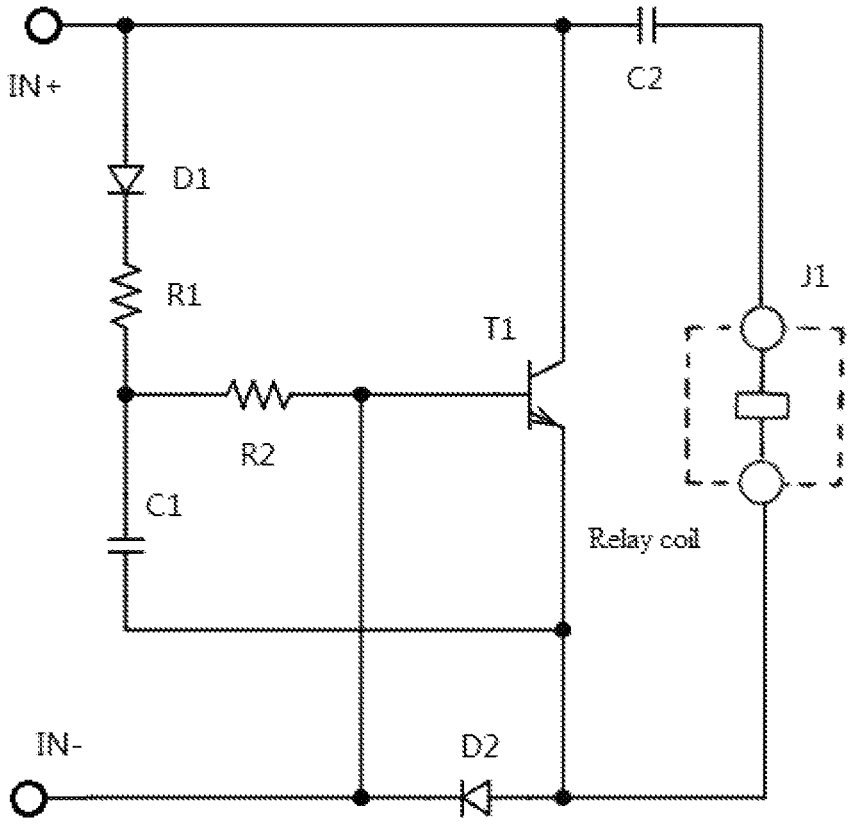
FIG. 8 is a schematic diagram 1 of a control circuit for a single coil magnetic latching relay according to an optional embodiment of the present disclosure.

FIG. 8 is a schematic diagram 1 of a control circuit for a single coil magnetic latching relay according to an optional embodiment of the present disclosure. As shown in FIG. 8, the circuit includes a first transistor T1, a first diode D1, a second diode D2, a first capacitor C1, a second capacitor C2, a first resistor R1, a second resistor R2 and a relay coil J1. The first transistor T1 is an NPN transistor.

The first diode D1 is connected to the first resistor R1 in series, an anode of the first diode D1 is connected to an input IN+, a collector electrode of the first transistor T1 and the second capacitor C2.

The other terminal of the first resistor R1 is connected to the second resistor R2 and the first capacitor C1.

The other terminal of the second resistor R2 is connected to an input IN−, a base electrode of the first transistor T1 and a cathode of the second diode D2.

The other terminal of the second capacitor C2 is connected to one end of the relay coil J1.

The other terminal of the first capacitor C1 is connected to an emitter electrode of the first transistor T1, an anode of the second diode D2 and the other end of the relay coil J.

Figure 9:
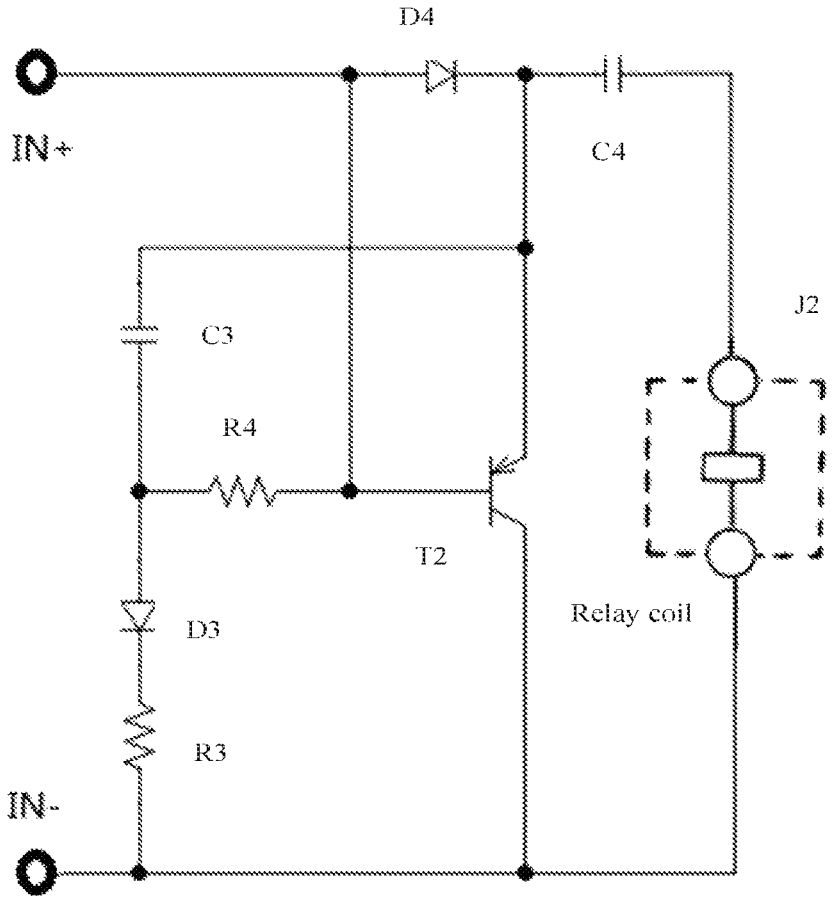
FIG. 9 is a schematic diagram 2 of a control circuit for a single coil magnetic latching relay according to an optional embodiment of the present disclosure.

FIG. 9 is a schematic diagram 2 of a control circuit for a single coil magnetic latching relay according to an optional embodiment of the present disclosure. As shown in FIG. 9, the circuit includes a second transistor T2, a third diode D3, a fourth diode D4, a third capacitor C3, a fourth capacitor C4, a third resistor R3, a fourth resistor R4 and a relay coil J2. The second transistor T2 is a PNP transistor.

The third diode D3 is connected to the third resistor R3 in series. The third resistor R3 is connected to an input IN−, a collector electrode of the second transistor T2 and the relay coil.

An anode of the third diode D3 is connected to the fourth resistor R4 and the third capacitor C3.

The other terminal of the fourth resistor R4 is connected to an input IN−, a base electrode of the second transistor T2 and an anode of the fourth diode D4.

The other terminal of the third capacitor C3 is connected to an emitter electrode of the second transistor T2, a cathode of the fourth diode D4 and the fourth capacitor C4.

The other terminal of the fourth capacitor C4 is connected to the other end of the relay coil J2.

Figure 10:
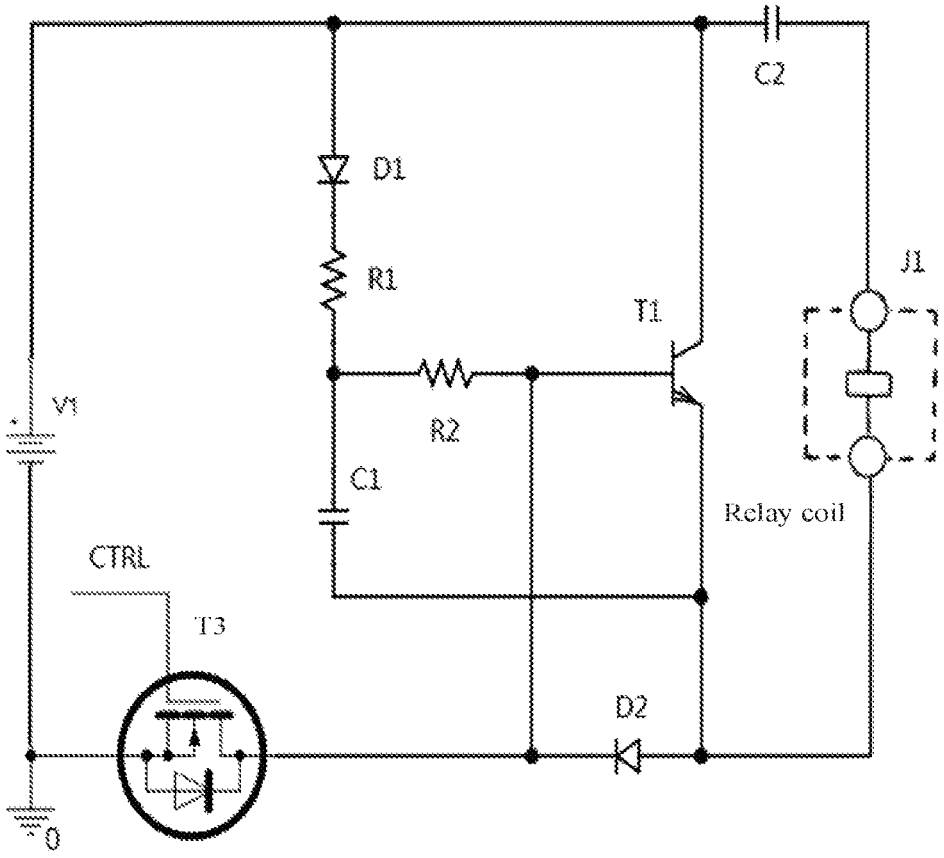
FIG. 10 is a schematic diagram 3 of a control circuit for a single coil magnetic latching relay according to an optional embodiment of the present disclosure.

FIG. 10 is a schematic diagram 3 of a control circuit for a single coil magnetic latching relay according to an optional embodiment of the present disclosure. As shown in FIG. 10, the circuit further includes a power supply V1 and an NMOS transistor T3 to input a voltage across IN+and IN−. When a ctrl signal is high, the power supply V1 is turned on and a relay coil J1 generates a positive pulse which is positive on the top and negative on the bottom to maintain the single coil magnetic latching relay in a set state. When the ctrl signal is low, the power supply V1 is turned off and the relay coil J1 generates a negative pulse which is negative on the top and positive on the bottom to maintain the single coil magnetic latching relay in a reset state.

Figure 11:
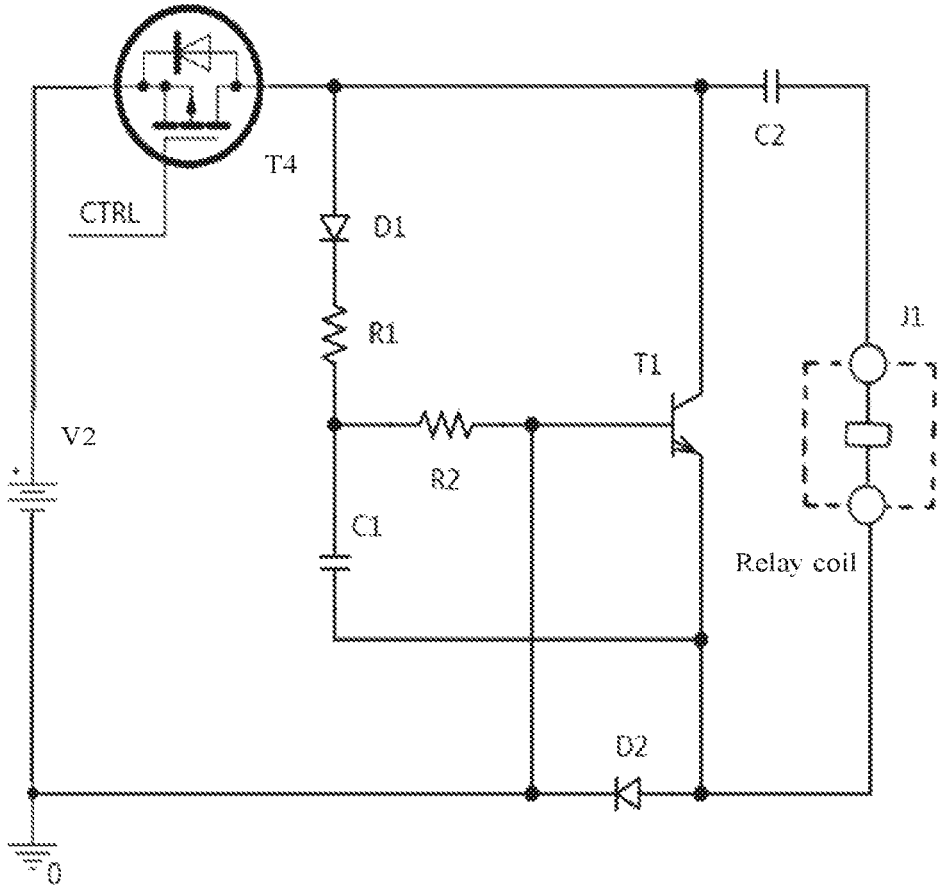
FIG. 11 is a schematic diagram 4 of a control circuit for a single coil magnetic latching relay according to an optional embodiment of the present disclosure.

FIG. 11 is a schematic diagram 4 of a control circuit for a single coil magnetic latching relay according to an optional embodiment of the present disclosure. As shown in FIG. 11, the circuit further includes a power supply V2 and a PMOS transistor T4 to input a voltage across IN+ and IN−. When a ctrl signal is low, the power supply V2 is turned on and a relay coil generates a positive pulse which is positive on the top and negative on the bottom to maintain the single coil magnetic latching relay in a set state. When the ctrl signal is high, the power supply V2 is turned off and the relay coil generates a negative pulse which is negative on the top and positive on the bottom to maintain the single coil magnetic latching relay in a reset state.

Embodiment 5

From the description of the embodiments described above, it will be apparent to those skilled in the art that the method of any embodiment described above may be implemented by software plus a necessary general-purpose hardware platform, or may of course be implemented by hardware, but in many cases, the former is a preferred implementation mode. Based on this understanding, the present dislosure may be embodied in the form of a software product. The software product is stored on a storage medium (such as a ROM/RAM, a magnetic disk or an optical disk) and includes several instructions for enabling a terminal device (which may be a mobile phone, a computer, a server or a network device) to execute the method according to each embodiment of the present disclosure.

A computer-readable storage medium is configured to store computer-executable instructions for executing the control method for a single coil magnetic latching relay when executed by a processor.

An embodiment of the present disclosure further provides a storage medium. In this embodiment, the storage medium described above may be configured to store program codes for executing the step described below.

In S11, a first control circuit controls a first single coil magnetic latching relay coil to enter a preset state and/or maintain the preset state.

The first control circuit includes: a first transistor, a first diode, a second diode, a first capacitor, a second capacitor, a first resistor and a second resistor. A collector electrode of the first transistor is connected to an anode of the first diode and a first terminal of the second capacitor. An emitter electrode of the first transistor is connected to an anode of the second diode, a first terminal of the first capacitor and one end of the first single coil magnetic latching relay coil. A base electrode of the first transistor is connected to a cathode of the second diode and a first terminal of the second resistor. A cathode of the first diode is connected to a first terminal of the first resistor. A second terminal of the first resistor is connected to a second terminal of the first capacitor and a second terminal of the second resistor. A second terminal of the second capacitor is connected to an other end of the first single coil magnetic latching relay coil.

In an embodiment, the storage medium is further configured to store program codes for executing the step in the method according to the embodiments described above.

In S21, a second control circuit controls a second single coil magnetic latching relay coil to enter a preset state and/or maintain the preset state.

The second control circuit includes: a second transistor, a third diode, a fourth diode, a third capacitor, a fourth capacitor, a third resistor and a fourth resistor. An emitter electrode of the second transistor is connected to a first terminal of the third capacitor, a cathode of the fourth diode and a first terminal of the fourth capacitor. A collector electrode of the second transistor is connected to a first terminal of the third resistor and one end of the second single coil magnetic latching relay coil. A base electrode of the second transistor is connected to an anode of the fourth diode and a first terminal of the fourth resistor. A second terminal of the fourth resistor is connected to a second terminal of the third capacitor and an anode of the third diode. A cathode of the third diode is connected to a second terminal of the third resistor. A second terminal of the fourth capacitor is connected to an other end of the second single coil magnetic latching relay coil.

In this embodiment, the storage medium may include, but is not limited to, a U disk, a read-only memory (ROM), a random access memory (RAM), a mobile hard disk, a magnetic disk, an optical disk or another medium capable of storing program codes.

In this embodiment, the processor may execute the steps in the methods according to the embodiments described above according to the program codes stored in the storage medium.

For examples in this embodiment, reference may be made to the examples described in the embodiments and optional implementation modes described above, and the examples will not be repeated in this embodiment.

Apparently, those skilled in the art should know that each of the above-mentioned modules or steps of the present disclosure may be implemented by a general-purpose computing device, the modules or steps may be concentrated on a single computing device or distributed on a network formed by multiple computing devices, and alternatively, the modules or steps may be implemented by program codes executable by the computing devices, so that the modules or steps may be stored in a storage device and executable by the computing devices. In some circumstances, the illustrated or described steps may be executed in sequences different from those described herein, or the illustrated or described modules or steps may be made into various integrated circuit modules separately or multiple modules or steps therein may be made into a single integrated circuit module for implementation. In this way, the embodiments of the present disclosure are not limited to any specific combination of hardware and software.

The above are only optional embodiments of the present disclosure and are not intended to limit the present disclosure, and for those skilled in the art, the present disclosure may have various modifications and variations. Any modifications, equivalent substitutions, improvements and the like made within the spirit and principle of the present disclosure are within the scope of the present disclosure.

INDUSTRIAL APPLICABILITY

In the embodiments of the present disclosure, the control circuit for a single coil magnetic latching relay includes one transistor, thereby reducing the complexity of a control circuit for a single coil magnetic latching relay.

What is claimed is:

1. A control circuit for a single coil magnetic latching relay, comprising: a first control circuit and a first single coil magnetic latching relay coil;

wherein the first control circuit comprises: a first transistor, a first diode, a second diode, a first capacitor, a second capacitor, a first resistor and a second resistor;

a collector electrode of the first transistor is connected to an anode of the first diode and a first terminal of the second capacitor; an emitter electrode of the first transistor is connected to an anode of the second diode, a first terminal of the first capacitor and one end of the first single coil magnetic latching relay coil; and a base electrode of the first transistor is connected to a cathode of the second diode and a first terminal of the second resistor;

a cathode of the first diode is connected to a first terminal of the first resistor, and a second terminal of the first resistor is connected to a second terminal of the first capacitor and a second terminal of the second resistor;

a second terminal of the second capacitor is connected to an other end of the first single coil magnetic latching relay coil; and the first control circuit is configured to control the first single coil magnetic latching relay coil to enter a preset state and/or maintain the preset state.

2. The control circuit for a single coil magnetic latching relay according to claim 1, wherein the anode of the first diode is further connected to a high-level input voltage; and the cathode of the second diode is further connected to a low-level input voltage.

3. The control circuit for a single coil magnetic latching relay according to claim 1, wherein the first control circuit further comprises a first drive circuit, wherein a high-level input end of the first drive circuit is connected to the anode of the first diode and a low-level input end of the first drive circuit is connected to the cathode of the second diode, and the first drive circuit is configured to provide a drive voltage for the first single coil magnetic latching relay coil.

4. The control circuit for a single coil magnetic latching relay according to claim 3, wherein the first drive circuit comprises a first power supply and a first control element, wherein a positive electrode of the first power supply is connected to the anode of the first diode, a negative electrode of the first power supply is connected to the first control element, the first control element is connected to the cathode of the second diode, the first power supply is configured to provide the drive voltage for the first single coil magnetic latching relay coil and the first control element is configured to control the first power supply to be turned on or off.

5. The control circuit for a single coil magnetic latching relay according to claim 1, wherein the first transistor comprises an NPN transistor.

6. A control circuit for a single coil magnetic latching relay, comprising: a second control circuit and a second single coil magnetic latching relay coil;

wherein the second control circuit comprises: a second transistor, a third diode, a fourth diode, a third capacitor, a fourth capacitor, a third resistor and a fourth resistor;

an emitter electrode of the second transistor is connected to a first terminal of the third capacitor, a cathode of the fourth diode and a first terminal of the fourth capacitor; a collector electrode of the second transistor is connected to a first terminal of the third resistor and one end of the second single coil magnetic latching relay coil; and a base electrode of the second transistor is connected to an anode of the fourth diode and a first terminal of the fourth resistor;

a second terminal of the fourth resistor is connected to a second terminal of the third capacitor and an anode of the third diode; and a cathode of the third diode is connected to a second terminal of the third resistor;

a second terminal of the fourth capacitor is connected to an other end of the second single coil magnetic latching relay coil; and the second control circuit is configured to control the second single coil magnetic latching relay coil to enter a preset state and/or maintain the preset state.

7. The control circuit for a single coil magnetic latching relay according to claim 6, wherein the anode of the fourth diode is further connected to a high-level input voltage;

and the collector electrode of the second transistor is further connected to a low-level input voltage.

8. The control circuit for a single coil magnetic latching relay according to claim 6, wherein the second control circuit further comprises a second drive circuit, wherein a high-level input end of the second drive circuit is connected to the anode of the fourth diode and a low-level input end of the second drive circuit is connected to the collector electrode of the second transistor, and the second drive circuit is configured to provide a drive voltage for the second single coil magnetic latching relay coil.

9. The control circuit for a single coil magnetic latching relay according to claim 8, wherein the second drive circuit comprises a second power supply and a second control element, wherein a positive electrode of the second power supply is connected to the second control element, a negative electrode of the second power supply is connected to the collector electrode of the second transistor, the second control element is connected to the anode of the fourth diode, the second power supply is configured to provide the drive voltage for the second single coil magnetic latching relay coil and the second control element is configured to control the second power supply to be turned on or off.

10. The control circuit for a single coil magnetic latching relay according to claim 6, wherein the second transistor comprises a PNP transistor.

11. A control method for a single coil magnetic latching relay, comprising:

controlling, by a first control circuit, a first single coil magnetic latching relay coil to enter a preset state and/or maintain the preset state;

wherein the first control circuit comprises: a first transistor, a first diode, a second diode, a first capacitor, a second capacitor, a first resistor and a second resistor; a collector electrode of the first transistor is connected to an anode of the first diode and a first terminal of the second capacitor; an emitter electrode of the first transistor is connected to an anode of the second diode, a first terminal of the first capacitor and one end of the first single coil magnetic latching relay coil; a base electrode of the first transistor is connected to a cathode of the second diode and a first terminal of the second resistor; a cathode of the first diode is connected to a first terminal of the first resistor; a second terminal of the first resistor is connected to a second terminal of the first capacitor and a second terminal of the second resistor; and a second terminal of the second capacitor is connected to an other end of the first single coil magnetic latching relay coil.

12. The control method for a single coil magnetic latching relay according to claim 11, wherein the preset state comprises a set state and/or a reset state.

13. The control method for a single coil magnetic latching relay according to claim 12, wherein the controlling, by the first control circuit, the first single coil magnetic latching relay coil to enter the preset state comprises:

inputting a high-level drive voltage to the anode of the first diode; and controlling, by a loop consisting of the second capacitor, the first single coil magnetic latching relay coil and the second diode, the first single coil magnetic latching relay coil to enter the set state.

14. The control method for a single coil magnetic latching relay according to claim 13, further comprising:

turning off the drive voltage inputted to the anode of the first diode after controlling the first single coil magnetic latching relay coil to enter the set state; and controlling, by the first control circuit, the first single coil magnetic latching relay coil to enter the reset state.

15. A control method for a single coil magnetic latching relay, comprising:

controlling, by a second control circuit, a second single coil magnetic latching relay coil to enter a preset state and/or maintain the preset state;

wherein the second control circuit comprises: a second transistor, a third diode, a fourth diode, a third capacitor, a fourth capacitor, a third resistor and a fourth resistor; an emitter electrode of the second transistor is connected to a first terminal of the third capacitor, a cathode of the fourth diode and a first terminal of the fourth capacitor; a collector electrode of the second transistor is connected to a first terminal of the third resistor and one end of the second single coil magnetic latching relay coil; a base electrode of the second transistor is connected to an anode of the fourth diode and a first terminal of the fourth resistor; a second terminal of the fourth resistor is connected to a second terminal of the third capacitor and an anode of the third diode; a cathode of the third diode is connected to a second terminal of the third resistor; and a second terminal of the fourth capacitor is connected to an other end of the second single coil magnetic latching relay coil.

16. The control method for a single coil magnetic latching relay according to claim 15, wherein the preset state comprises a set state and/or a reset state.

17. The control method for a single coil magnetic latching relay according to claim 16, wherein the controlling, by the second control circuit, the second single coil magnetic latching relay coil to enter the preset state comprises:

inputting a high-level drive voltage to the anode of the fourth diode; and controlling, by a loop consisting of the fourth diode, the fourth capacitor and the second single coil magnetic latching relay coil, the second single coil magnetic latching relay coil to enter the set state.

18. The control method for a single coil magnetic latching relay according to claim 17, further comprising:

turning off the drive voltage inputted to the anode of the fourth diode after controlling the second single coil magnetic latching relay coil to enter the set state; and controlling, by the second control circuit, the second single coil magnetic latching relay coil to enter the reset state.

19. The control circuit for a single coil magnetic latching relay according to claim 2, wherein the first transistor comprises an NPN transistor.

20. The control circuit for a single coil magnetic latching relay according to claim 7, wherein the second transistor comprises a PNP transistor.

* * * * *